US006249920B1

(12) United States Patent
McRoberts

(10) Patent No.: US 6,249,920 B1
(45) Date of Patent: Jun. 26, 2001

(54) GRID DRAIN

(75) Inventor: Thomas Michael McRoberts, Glastonbury, CT (US)

(73) Assignee: McGuire Manufacturing Co., Inc., Cheshire, CT (US)

( * ) Notice: Subject to any disclaimer, the term of this patent is extended or adjusted under 35 U.S.C. 154(b) by 0 days.

(21) Appl. No.: 09/073,847

(22) Filed: May 7, 1998

(51) Int. Cl.[7] ..... E03C 1/26
(52) U.S. Cl. ..... 4/286; 4/292
(58) Field of Search ..... 4/286–295

(56) References Cited

U.S. PATENT DOCUMENTS

| | | | | |
|---|---|---|---|---|
| 169,551 | | 11/1875 | Jones, Jr. . | |
| 1,070,424 | * | 8/1913 | Danver | 4/288 |
| 2,073,899 | | 3/1937 | Luther . | |
| 2,130,943 | | 9/1938 | Boisvert . | |
| 2,591,632 | | 4/1952 | Stavoe et al. . | |
| 3,161,360 | | 12/1964 | Levine . | |
| 3,231,093 | | 1/1966 | Rampe . | |
| 3,742,525 | * | 7/1973 | Oropallo | 4/288 |
| 4,067,072 | * | 1/1978 | Izzi | 4/288 |
| 4,146,939 | * | 4/1979 | Izzi | 4/286 |
| 4,655,913 | | 4/1987 | Boersma . | |
| 4,910,811 | | 3/1990 | Izzi, Sr. . | |
| 5,050,247 | | 9/1991 | Hsu . | |
| 5,297,299 | | 3/1994 | Wilson . | |
| 5,724,684 | * | 3/1998 | Paar | 4/286 |

* cited by examiner

*Primary Examiner*—Charles R. Eloshway
(74) *Attorney, Agent, or Firm*—Banner & Witcoff, LTD.

(57) ABSTRACT

A grid drain for use in sinks without overflow drains comprising a solid cylindrical shell having an upper end and a lower end; the exterior side of the solid cylindrical shell has threads which thread from the lower end to the upper end; the upper end has an angulated flange arranged to seat in the drain opening in the sink; and the angulated flange has a top solid surface having a plurality of drain holes; wherein the size of the drain holes is large enough so that an air bubble will not form or will break immediately upon formation.

8 Claims, 3 Drawing Sheets

GRID DRAIN

BACKGROUND OF THE INVENTION

Typical sinks, in bathrooms for example, contain an opening near the top of the bowl that overflow water can drain into and an opening at the bottom of the sink as the main drain hole. Typically a channel is cast as part of the sink that takes the overflow water from the sink opening near the top to the main drain at the bottom of the sink. The sink casting includes the passage for the drain at the bottom of the sink. At the bottom of the sink, the casting flares out to provide support and leak protection.

A drain is placed in the main drain hole to direct the water into the pipe which carries the water away. There are many types of drains that can be placed in the drain hole at the bottom of the sink. For example, the grid drain has been used in lavatories (bathroom sinks) for decades.

A common grid drain is a solid casting, such as brass, having a top surface. The surface typically contains 19 holes that are in a six sided pattern. Each hole is the same diameter (5 mm) and the hole spacing is equidistant in each direction. The casting is approximately 6.5 cm long. From the bottom, the external side is threaded up about 2.4 mm. The internal area is fine machine threaded to accept a tail piece of varying length. Above the external threading are two openings of non-critical length and width. The openings are primarily used for overflow water drainage from the sink.

Thus, the typical bathroom sink is configured with an overflow opening and a drainage channel which connects to a chamber at the bottom of the sink. The standard drain is inserted into this chamber, with the bottom and top sealed to prevent leakage.

There is a growing demand for regular sinks not to have the overflow channel. For example, the Canadian Product Certification Board (CSA) has requested that all sinks in hospitals and other high risk infection areas have sinks without the overflow channel. There appears to be medical evidence that bacteria, germs, etc. can grow in these channels. In addition, there is a demand for stainless steel sinks in certain bathroom configurations. These are designed without overflows and with no bottom chamber.

In order to attach a grid drain to a sink without an overflow channel, there needs to be external threading all the way up to the bottom of the flange. There cannot be any openings in the side of the drain. Otherwise, water will spill out on the floor.

In response, the current grid drain was modified by not cutting an overflow hole but instead providing external threads up to the flange. This arrangement allows the drain to be installed without leaking. However, if sufficient water flows on to the top of the drain, an air bubble will form directly under the top flange, inside the drain. This is called the "venturi effect." The flowing water over the top of the drain causes low pressure to form in the drain. This manifests itself into an air bubble. This air bubble effectively blocks the drain. Water will build up in the sink and could eventually spill out. Until the air bubble dissipates, water is blocked from the drain.

In a conventional sink with an overflow chamber, the air bubble dissipates up the channel whenever it forms. The overflow chamber channel acts as a vent or a pressure equalizer. Thus, without pressure equalization, air bubbles will form on the underside of the grid drain. The air bubbles block the drain from releasing sufficient water from the sink to avoid overflow of the water.

There is a need for an effective grid drain that can be used without an overflow chamber.

SUMMARY OF THE INVENTION

The present invention is directed to a grid drain for use in sinks without overflow drains. The grid drain has a solid cylindrical shell having an upper end and a lower end; the exterior side of the solid cylindrical shell has threads which thread from the lower end to the upper end; the upper end has an angulated flange arranged to seat in the drain opening in the sink; and the angulated flange has a top solid surface having at least 10 drain holes; wherein the size of the drain holes is large enough so that an air bubble will not form or will break immediately upon formation.

The present invention is directed to a grid drain wherein the pattern of drain holes in the grid is not uniform, adjacent drain holes not being equidistantly spaced from each other.

The grid drain of the present invention allows the water in the sink to flow out of the sink without air bubble difficulties. The air bubbles are broken before they are sufficiently formed to cause a problem.

The grid drain of the present invention is ideal for new sanitary sink constructions having no overflow drains, such as now used in some hospitals. Thus, the present invention is also directed to a grid drain and sink combination.

DETAILED DESCRIPTION OF THE PREFERRED EMBODIMENTS

A problem with using standard grid drains which have been modified to use in sinks without overflow holes is that the sinks will not drain due to the buildup of air bubbles under the grid drain holes. It was discovered that the buildup was due to the combination of the grid drain hole size and the grid drain pattern.

It was further discovered that if the air bubble pattern is broken up so that there is maximum potential for an edge of the bubble to fall inside the edge of a hole, then the bubble would break down. Air in the bubble then escapes allowing the water to drain. It was further discovered that the number of holes is not as important as the individual hole size.

Figure 1:
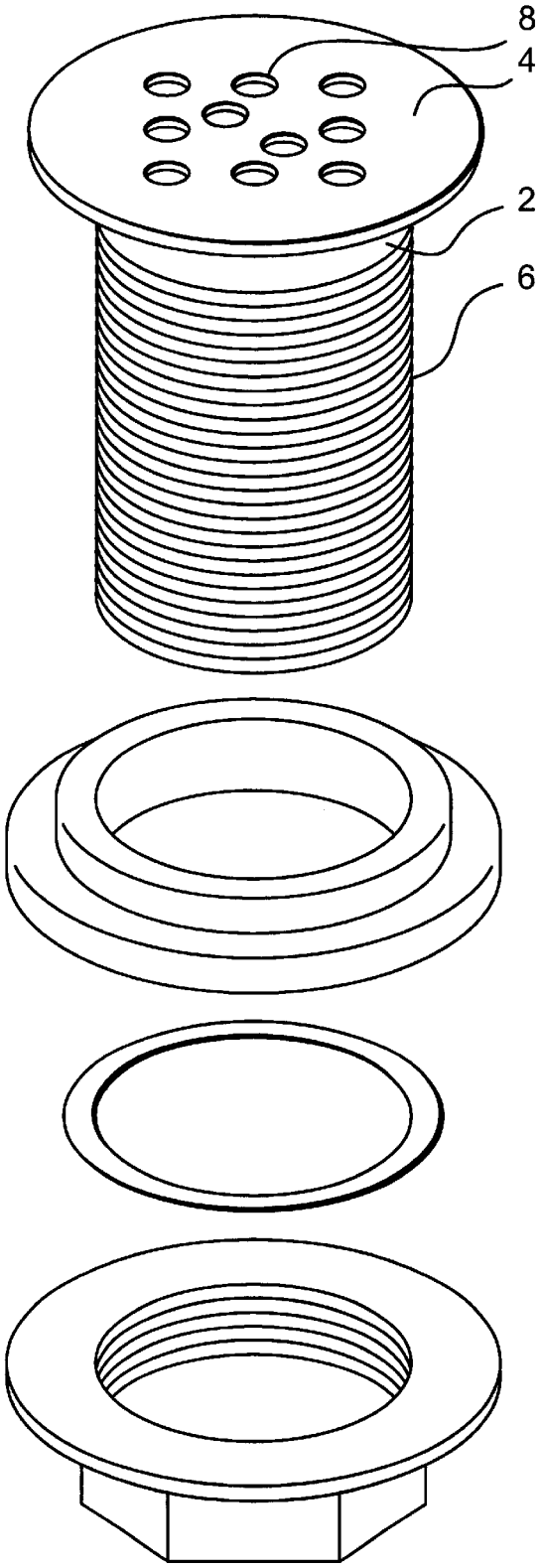
FIG. 1 depicts a grid drain in accordance with the claimed invention.

Referring to FIG. 1, a solid cylindrical shell 2 has an upper end and a lower end. On the upper end is an angulated flange 4 arranged to seat in the drain opening in the sink. The exterior side of the solid cylindrical shell has threads 6 which thread from the lower end to the upper end of the shell. The angulated flange has a solid top surface which contains a plurality of holes 8. The holes are preferably circular although other shapes, e.g. square, may be used.

Figure 2:
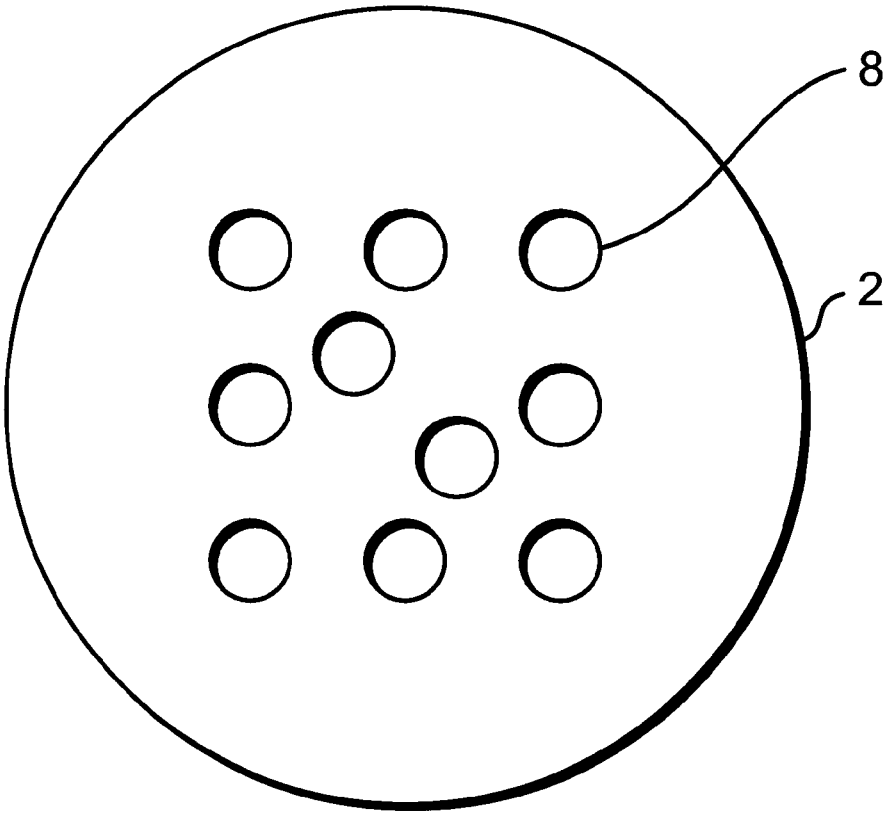
FIG. 2 depicts a preferred hole pattern for the top surface of the grid drain.

Turning to FIG. 2, most of the holes 8 are placed along the perimeter of the flange as close to the outer edge of the flange as possible. At least two inside holes are placed closer to the center of the drain. The perimeter holes are not each equidistant from the inside holes. This offset pattern allows for the maximum number and size of holes while still maintaining maximum strength of the drain as cast.

The drain holes have a diameter large enough so that an air bubble will not form or will break immediately upon formation. The diameter of each hole is greater than 6 mm, preferably between about 7 to 10 mm, and most preferably about 8 mm. Each individual hole may be of a different size, but preferably each hole size is the same. It is preferred that the number of holes is the maximum number that can be used based on the individual hole size while still maintaining structural integrity of the grid drain. For example, a standard grid drain having holes 7–8 mm in diameter will have 10 holes. The hole spacing is not equidistant in each direction.

A drain in accordance with the present invention is preferably a solid metal casting, such as brass, having a chrome-plated top surface. The drain may also be made of plastic or other suitable material. The size of the casting is preferably about 6.5 cm long. From the bottom, the external side is threaded up close to the top of the casting, about 4 to 4.5 mm. The internal area is fine machine threaded to accept a tail piece of varying length. The casting is solid and does not contain any openings for overflow water drainage from the sink.

Figure 3:
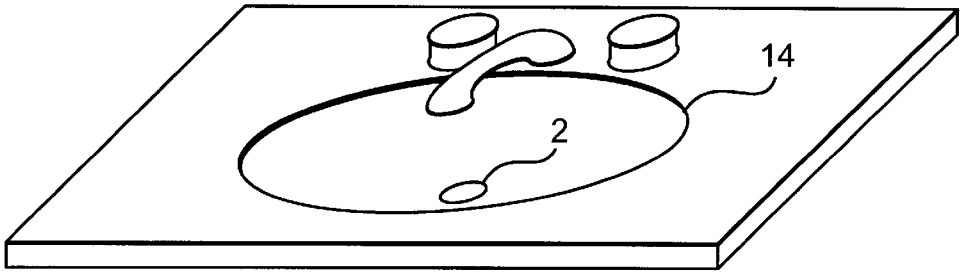
FIG. 3 depicts a combination of grid drain and sink in accordance with the present invention.
Figure 4:
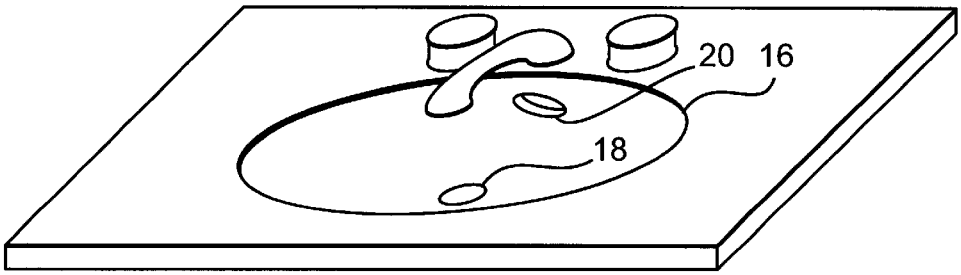
PRIOR ART Fig. 4
FIG. 4 depicts a prior art combination of grid drain and sink having a conventional overflow hole.

FIG. 3 is a sink and drain combination in accordance with the present invention. The sink 14 has no overflow chamber. FIG. 4 is a prior art sink 16 and drain 18 combination having a standard overflow opening 20.

The drain 2 of FIG. 1 is placed and connected to the bottom of the sink 14. By conventional techniques of applying a sealant around the periphery of the flange 4 and tightening a collar nut 12 on the threads 6 until the upper surface of the nut abuts and is tightened against the lower surface of the drain hole in the sink. A rubber washer 10 and paper washer 11 are typically placed between the collar nut and lower surface of the sink.

EXAMPLES

Two grid drains were made and compared in standard lavatory sinks without overflow chambers. The first grid drain had 10 offset holes with each hole having a diameter of 8 mm. The second grid drain had the same pattern as the first grid drain with 10 offset holes with each hole having a diameter of 6 mm. After installation of each grid drain in a sink the faucets were turned at the maximum rate (8.3 liters/min).

Water drained from the sink containing the first grid drain Any bubbles formed using the first grid drain burst whenever the water accumulated between ½ and 1 inch deep in the sink. Water did not drain from the sink containing the second grid drain and the faucets needed to be turned off to avoid water from overflowing.

It will be apparent to those skilled in the art that various modifications and variations can be made in the compositions and methods of the present invention without departing from the spirit or scope of the invention. Thus, it is intended that the present invention cover the modifications and variations of this invention provided they come within the scope of the appended claims and their equivalents.

What is claimed is:

1. A grid drain for use in sinks without overflow drains comprising a solid cylindrical shell having a diameter to fit a standard bathroom sink and having an upper end and a lower end; the exterior side of the solid cylindrical shell has continuous threads from the lower end to adjacent the upper end; the upper end has an angulated flange arranged to seat in the drain opening in the sink; and the angulated flange has a top solid surface having at least 10 drain holes wherein holes are placed along the perimeter of the flange close to the outer edge of the flange and at least two holes are placed closer to the center of the drain whereby the perimeter holes are not each equidistant from the inside holes; wherein the size of the drain holes is greater than 6 mm to about 10 mm in diameter.

2. The grid drain of claim 1 wherein the drain holes are circular.

3. The grid drain of claim 1 wherein the drain holes have a diameter of about 7 to 10 mm.

4. The grid drain of claim 3 wherein the drain holes have a diameter of about 8 mm.

5. A sink and grid drain combination comprising a standard bathroom sink having a hole for a drain at the bottom of the sink and having no overflow outlet at an upper area and a grid drain placed in the hole at the bottom of the sink, said grid drain comprising a solid cylindrical shell having a diameter to fit a standard bathroom sink and having an upper end and a lower end; the exterior side of the solid cylindrical shell has continuous threads from the lower end to adjacent the upper end; the upper end has an angulated flange arranged to seat in the drain hole in the sink; and the angulated flange has a top solid surface having at least 10 drain holes wherein holes are placed along the perimeter of the flange close to the outer edge of the flange and at least two holes are placed closer to the center of the drain whereby the perimeter holes are not each equidistant from the inside holes; wherein the size of the drain holes is greater than 6 mm to about 10 mm in diameter.

6. The combination of claim 5 wherein the drain holes have a diameter of about 7 to 10 mm.

7. The combination of claim 6 wherein the drain holes have a diameter of about 8 mm.

8. A grid drain for use in sinks without overflow drains comprising a solid cylindrical shell having a diameter to fit a standard bathroom sink and having an upper end and a lower end; the exterior side of the solid cylindrical shell has continuous threads from the lower end to adjacent the upper end; the upper end has an angulated flange arranged to seat in the drain opening in the sink; and the angulated flange has a top solid surface having 10 drain holes wherein holes are placed along the perimeter of the flange close to the outer edge of the flange and at least two holes are placed closer to the center of the drain whereby the perimeter holes are not each equidistant from the inside holes; wherein the drain holes have a diameter of about 8 mm.

* * * * *